United States Patent [19]

Usami

[11] 4,147,350

[45] Apr. 3, 1979

[54] SIMULATED BALL RETURN TOY

[75] Inventor: Hikoo Usami, Tokyo, Japan

[73] Assignee: Tomy Kogyo Co., Inc., Tokyo, Japan

[21] Appl. No.: 861,828

[22] Filed: Dec. 19, 1977

[30] Foreign Application Priority Data

Dec. 21, 1976 [JP] Japan ..... 51/153588

[51] Int. Cl.[2] ..... A63F 9/14

[52] U.S. Cl. ..... 273/85 R; 273/1 E

[58] Field of Search ..... 273/85 R, 1 R, 1 E, 273/101.1, 101.2, DIG. 28

[56] References Cited

U.S. PATENT DOCUMENTS

| | | | |
|---|---|---|---|
| 3,993,309 | 11/1976 | Morris et al. | 273/85 R |
| 4,006,897 | 2/1977 | Llorens | 273/85 R |
| 4,006,899 | 2/1977 | Lohr et al. | 273/85 R |

FOREIGN PATENT DOCUMENTS

| | | | |
|---|---|---|---|
| 2646054 | 5/1977 | Fed. Rep. of Germany | 273/85 R |

*Primary Examiner*—Paul E. Shapiro

*Attorney, Agent, or Firm*—Edward D. O'Brian

[57] ABSTRACT

A toy usable as a game effectively simulating an adult game such as tennis, Ping Pong or the like can be constructed so as to utilize a housing having a rectangular opening which is preferably covered by a translucent screen. A light within the interior of the housing simulating the ball in such a game is visible through the screen. The light is mounted upon a member within the housing which is capable of being moved back and forth between different positions adjacent to the ends of the opening. A mechanical drive structure is provided for moving the member between such positions. At least one and preferably a plurality of parts capable of engaging the member so as to hold the member against movement is located in the housing. Such holding parts are movably mounted so as to be capable of being moved from engaging positions in which they are capable of engaging the holding member to non-engaging positions in which they will not engage the member. Release structures are preferably provided for moving adjacent holding parts from a first location in which these holding parts are individually capable of being moved between the noted positions to a second location in which none of the holding parts is operative to hold the member against movement.

18 Claims, 11 Drawing Figures

SIMULATED BALL RETURN TOY

CROSS-REFERENCE TO RELATED APPLICATIONS

U.S. Patent Application Ser. No. 733,392, filed Oct. 18, 1976, by Hideyuki Kanno, entitled "GAME STRUCTURE".

BACKGROUND OF THE INVENTION

The invention set forth in this specification pertains to new and improved simulated ball return toys and more specifically simulated ball return toys which can be utilized as games effectively simulating adult games such as tennis, ping pong and the like.

A number of different electronic game structures have been developed which effectively simulate various different adult games. The most prevalent of such game structures have normally been constructed so as to include a cathode ray tube and an appropriate electronic circuit structure enabling a light dot simulating a playing piece such as a ball to move back and forth between light bars simulating rackets or the like. These game structures have normally been constructed so as to include what may be loosely referred to as "scoring means" serving to indicate when such bars have been appropriately manipulated so as to cause such a light dot to reverse itself on such a tube. Game structures of this type are considered highly desirable for play and amusement type purposes.

Unfortunately cathode ray tube type simulated games as indicated in the preceding paragraph are both relatively expensive and relatively immobile. The costs of such devices has in many cases tended to preclude their being widely utilized. Further, since such games normally utilize as a cathode ray tube a conventional TV tube, it is obvious that they cannot be conveniently moved about from one location to another. For a toy type game to be effectively and widely utilized such a structure has to be sufficiently small in size so that it can be moved from one location to another without difficulty by users such as children.

As a result of the limitations of cathode ray tube type simulated games a number of efforts have been made toward the development of essentially mechanical type simulated ball return toys usable in simulating various types of adult games. Although such prior mechanical structures have been effective as toys they also are considered to be disadvantageous in character. In general such structures simulating cathode ray tube type games have tended to be undesirably large. This effectively precludes their being moved from one location to another. It is considered that the sizes of such prior essentially mechanical ball return toys or games is primarily the result of a lack of recognition as to how to construct a small sized, effective mechanical drive structure which will move a member carrying a light source simulating a ball.

Further, such essentially mechanical type simulated ball return toys or games are considered to be relatively undesirable in that the mechanical structures employed in them have been of such a character as not to effectively simulate the action actually achieved in an adult game such as tennis, ping pong and the like. In such an adult game when one of the players of such a game misses the ball a point is scored and the ball is temporarily located out of play until such time as a player serves the ball again. These prior mechanical type simulated TV games have frequently been constructed so that a movable member simulating a ball keeps moving instead of stopping when the ball has not been "returned" as in continuing the play through the manipulation or operation of the game.

SUMMARY OF THE INVENTION

As a result of these considerations it is considered there is a need for a new and improved ball return toy usable as a game. A broad or basic objective of the present invention is to fulfill this need. More specifically the invention is intended to provide simulated ball return toys or games of a mechanical character which are comparatively small in size and which in spite of their small size serve to achieve an effective simulated game action.

The invention is also intended to provide mechanical type simulated ball return toys simulating adult games which are of such a character as to effectively simulate the ball stopping action occurring in such an adult game when a ball is not properly engaged, as, for example, by a tennis racket or the like. The invention is also intended to provide toys usable as games as described which can be manufactured at a comparatively nominal cost, which are effective for their intended purpose over a prolonged period without significant maintenance, and which are constructed so as to withstand the normal abuse accorded any toy by a child.

In accordance with this invention these objectives are achieved by providing a toy having a housing, said housing including an opening having elongated, opposed ends through which a part of the content of said housing can be viewed, a member located within said housing so as to be capable of being moved back and forth between different positions along said ends of said opening, drive means for moving said member back and forth between different positions along said ends of said opening, said drive means being operatively connected to said movable member, in which the improvement comprises: a holding means for engaging and holding said member against movement when contacted by said member, said holding means being movably mounted within said housing so as to be capable of being moved between an engaging position in which it is capable of engaging and holding said member as said member is moved into contact with said holding means and a non-engaging position in which it will not engage and hold said member.

In accordance with this invention these objectives are also achieved by providing in a toy of the type indicated having a housing, said housing including an opening through which a part of the content of the housing can be viewed, a member located within the housing so as to be capable of moving back and forth between different positions along said ends of said opening, drive means for moving said member back and forth between different positions along said ends of said opening, said drive means being operatively connected to said movable member, in which comprises: said member comprising an elongated means, said drive means including a support plate, a reciprocating means for moving said support plate in an irregular oscillating manner, a crank means pivotally mounted on said support plate, oscillating means for oscillating said crank means relative to said support plate, and said motor means for concurrently operating said reciprocating and said oscillating means, said reciprocating means being operatively connected to said support plate, said oscillating means being operatively connected to said crank means, said motor means being operatively connected to both said reciprocating and said oscillating means, said crank means being pivotally connected to said member and including cooperating sliding connection means located on said arm and said support plate for pivotally and slidingly connecting said arm to said support plate remote from the connection of said crank means and said arm.

BRIEF DESCRIPTION OF THE DRAWINGS

Because of the inherent nature of the invention it is best more fully explained with reference to the accompanying drawings in which.

Figure 1:
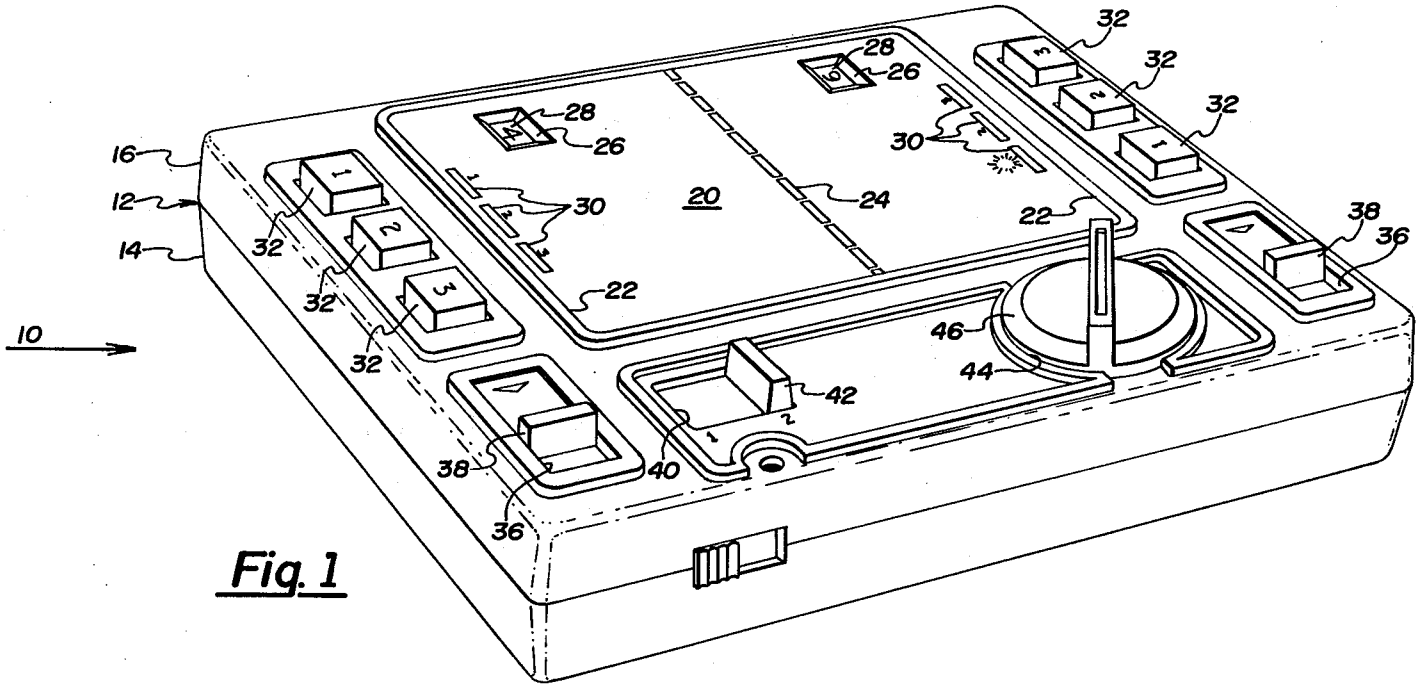
FIG. 1 is a perspective view of a presently preferred embodiment of a toy game in accordance with this invention.
Figure 4:
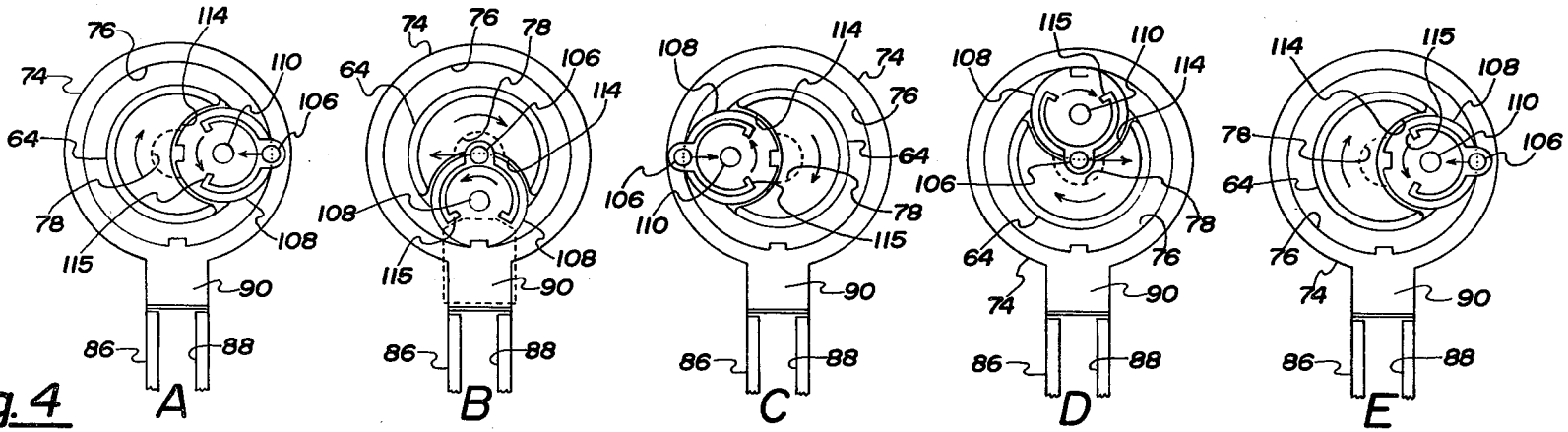
FIGS. 4A, B, C, D and E are a sequence of diagrammatic views indicating positions of some parts of the drive mechanism indicated in the preceding FIG. 3.

It will be apparent to those skilled in the field of the construction of complex mechanical toys that the particular game illustrated is constructed so as to utilize operative concepts or principles as are defined in the appended claims forming a part of this specification. Such individuals will realize that these concepts or principles may be easily embodied within a large number of differently constructed and differently appearing toys or games through the use or exercise of routine engineering skill in the toy industry. For this reason this invention is not to be considered as being limited to the precise toy game illustrated in the drawing.

DETAILED DESCRIPTION

In the drawings there is shown a toy 10 usable as a game effective in simulating an adult game such as tennis, ping pong or the like. This toy includes a housing 12 having a base 14 and a lid or cover 16 fitting on the base 14. This cover 16 is constructed so as to include an enlarged opening 18 which is enclosed or covered by a translucent screen 20. This opening 18 has elongated, opposed ends. This screen 20 is provided with an indicia 24 simulating a conventional game net such as is used in tennis, Ping Pong or the like. It also is provided with windows 26 through which portions of score indicating wheels 28 are visible. The screen 20 also is provided with two series (not separately numbered) of indicia 30 used in simulating racket or other ball return instrument positions.

The cover 16 serves to carry two sets (not separately numbered) of buttons 32. Each of these buttons 32 is mounted in a tubular, dependent sleeve 34 formed integrally with the cover 16 so as to be capable of being moved linearly with respect to the cover 16. Each of these buttons 32 corresponds to one of the indicia 30 previously described.

The cover 16 also includes two openings 36 which are adapted to expose release members 38 so that they may be appropriately actuated as hereinafter indicated. The cover 16 is also provided with an opening 40 which is intended to expose a latch lever 42 so that this latch lever 42 may be appropriately actuated as hereinafter indicated. This cover 16 is further provided with another opening 44 which serves to expose a winding knob 46 which is attached to and forms a part of a conventional type of spring motor 48.

This spring motor 48 is mounted within the base 14 and is not described herein in detail because it is essentially of a conventional character. It is intended to provide a mechanical power through a gear 50 to what may be referred to herein as a drive means (not separately numbered) consisting of various parts as hereinafter described for moving a member 52 shaped as an elongated arm within the interior of the housing 12 relative to the opening 18. If desired, the motor 48 may be considered as a part of the drive means employed.

This drive means (not numbered) is mounted on and in effect includes three different bosses 54, 56 and 58 serving as pivots which are formed integrally with the base 14. The boss 54 rotatably carries a spur gear 60 which mates with the gear 50 so as to be driven by the gear 50. The boss 56 carries a small pinion gear 62 which is formed as a part of an eccentric drive plate 64. This gear 62 mates with the gear 60. The boss 58 carries another spur gear 66 which mates with the pinion gear 62 so as to be driven by this pinion gear 62 as the gear 50 operates so as to turn the gear 60.

The spur gear 60 is provided with an irregular, continuous cam ridge 68; the gear 66 is provided with a similar cam ridge 70. These cam ridges 68 and 70 are located on the surfaces of the gears 60 and 66 (not separately numbered) remote from the base 14. The utilization of these cam ridges 68 and 70 is hereinafter explained.

This base 14 also is provided with spacing bosses or projections 72 which extend upwardly above the level of the gears 60 and 62. These bosses 72 are provided for the purpose of supporting what may be loosely referred to as a multi-function support plate 74. This support plate 74 is generally of a disk-like shape and is provided with an integral, internal ring gear 76 located concentrically about an opening 78. This opening 78 fits loosely about the pinion gear 62.

This central plate 74 is provided with opposed edge ears 80 which in turn are provided with enlarged elongated, arcuate slots 82. The plate 74 is loosely fastened or secured to the base 14 through the use of headed screws 84 which are engaged with the bosses 62. It is important that these screws 84 fit loosely within the slots 82 so as to permit movement of the plate 74 as hereinafter described.

The plate 74 also includes an elongated arm 86 extending radially from the opening 78. This arm 86 is provided with an elongated slot 88 which also extends radially from the opening 78. The arm 86 carries a synchronizing projection 90 which extends inwardly from the arm 86 so as to overlie a small portion of the gear 76.

This synchronizing projection 90 is secured in place on the arm 86 through the use of a screw fastener 92.

The plate 74 also carries on its periphery (not separately numbered) two upstanding mounting bosses 94 which are utilized so as to carry a small plate 96. This plate 96 holds an integral upstanding shaft 98. This shaft 98 projects through a pivot opening 100 in a crank arm 102 employed as hereinafter indicated and is secured in place by a conventional retainer 101. This crank arm 102 includes an elongated slot 104 which cooperates with a pin 106 on an internal planetary type gear 108. This structure defines a pin and slot connection for use in oscillating or reciprocating the crank arm 102 in accordance with the movement of the gear 108.

This gear 108 has a centrally located mounting opening 110 which fits over a pin 112 on the drive plate 64. This pin 112 is centrally located in connection with a depression 114 on the drive plate 64. This depression 114 in effect serves as a holder for the gear 108. The gear 108 also includes a synchronizing notch 115 which cooperates with the extension 90 so as to assure a desired timing sequence.

As indicated in the preceding the drive plate 64 is integral with the gear 62 so that its rotation will be determined by the rotation of the gear 62. As the plate 64 rotates the gear 108 is supported by the pin 112 so as to mate with the gear 76 and rotates as a result of such engagement. Such rotation of the gear 108 causes rotation of the pin 106 which in turn causes the crank arm 102 to oscillate back and forth about the axis (not numbered) of the shaft 98. Such oscillation is with respect to the support plate 74.

A small boss 116 on the arm 102 fits within a pivot opening 118. This opening 118 is centrally located along the length of the member 52 in such a manner that this member 52 is free to pivot relative to the arm 102. A conventional headed fastener 120 is employed to secure the member 52 in place. The member 52 also includes a terminal cylindrical projection 122 which fits within the previously described slot 88 in the arm 86 so as to form another pin and slot type connection. This projection 122 is secured in place by another fastener 124 so that it can both rotate and slide along the length of the slot 88 in order to control the movement of the arm 52 in accordance with the back and forth movement of the crank arm 102.

With the toy 10 as the arm 52 is being moved in this manner it is also simultaneously being moved through the action of cam followers 126 and 128 engaging the cam 68 and cam 70, respectively. Such engagement results in the support plate 74 being reciprocated or oscillated in an irregular manner. By virtue of the fact that the crank arm 102 is held by the shaft 98 on this support plate 72 this motion is transmitted directly to the crank arm 102 and is of course transmitted to the member 52 both through the movement of the arm 86 and through the action of motion of the crank arm 102 as it is oscillated or reciprocated relative to the support plate 74.

This all occurs of course as the various gears 60, 62 and 66 are driven by the spring motor 48 as previously described. The support plate 74 is normally biased in such a manner as to hold the followers 126 and 128 against the cams 68 and 70 through the use of a small coil spring 130 connecting a projection 132 on the arm 86 with another corresponding projection 134 within the base 14. It is considered that with appropriate design modification relative to the cams 68 and 70 and the followers 126 and 128 that this spring 130 could be dispensed with.

The various parts designated in the preceding as being operated or driven by the spring motor 48 serve as an effective drive means for moving the arm 52 so that it reciprocates or oscillates in a very complex, apparently irregular, and apparently random manner so that a light source 136 mounted upon a flat end 138 of the arm 52 moves back and forth within the housing 12 generally between the ends 22. The type of motion involved here is regular and uniform in the sense that it is fixed by the physical attributes of the various parts described.

However, the motion involved is sufficiently complex from a mechanical standpoint so that the light source 136 is moved as described in what appears to be essentially an irregular or random manner so that the light source 136 appears to move from a point along the length of one of the ends 22 to another point along the length of the other end 22 and so on in much the manner in which a ball in the game of tennis will be hit back and forth by tennis players as the game of tennis is played. The motion of the light source 136 can also be compared to the motion of a Ping Pong ball in the game of Ping Pong or the motions of other types of playing pieces in other related games.

With the toy 10 the motion of the arm 52 is not directly observed, but is indirectly indicated to a user of the toy 10 by virtue of the illumination given off by the light source 136 being visible through the screen 20. In order to provide electric power to operate this light source 136 it is preferred to locate within the base 14 a conventional battery housing 140 containing batteries (not shown). Conventional contacts 142 extend from this housing 140 and are utilized in connection with conventional flexible wires 144 to connect the batteries (not shown) within the housing 140 in a series circuit (not separately identified) including the light source 136 and a conventional switch 146. This switch 146 has a sliding actuator 148 which extends to the exterior of the base 114 through a slot 150. If desired a conventional dropping resistor 152 may be located in this circuit.

In order to achieve an action of the toy 10 corresponding to a ball being hit or placed out of play as, for example, when such a ball is or is not engaged by a tennis racket, ping pong paddle or the like, the toy 10 includes a plurality of holding members 154. Three of these holding members 154 are located at the left hand side of the housing 12 and three of these holding members 154 are located at the right hand side of the housing 12. Each of these holding members 154 directly corresponds to one of the buttons 32 previously described. Each holding member 154 is located immediately beneath its corresponding button 32. These holding members 154 are constructed so as to include the same operative parts but differ slightly from one another in shape and configuration so as to compensate for the somewhat arcuate, irregular movement of the member 52 as the spring motor 48 is operated.

Each of the holding members 154 is an integral unit of a somewhat resilient material which includes a cylindrical end 156 serving to support a flat plate 158 carrying an extendent holding end 160. Each of these plates 158 is reinforced against flexure by a downwardly extending elongated reinforcing wall 162 extending outwardly from each cylindrical end 156. These ends 156 also support and hold elongated resilient springs 164 which engage the base 14 so as to tend to bias the plates 158 and the ends 160 generally upwardly.

The holding members 154 are mounted through the use of elongated rods 166 extending through the cylindrical ends 156. These rods 166 are in turn supported on bearing walls 168 formed integrally with the base 14 in such a manner as to hold the holding members 154 relative to one another so that all the holding members 154 on a rod 166 are capable of being moved as a unit. Such movement is preferably accomplished through the use of the release levers 38 previously described.

Each of these release levers 38 is integral with a retainer frame 170 having legs 172 slidably carried by one of the rods 166. These legs 172 are sufficiently far apart so as to accommodate all of the ends 156 on the holding members 154 located on each of the rods 166 in such a manner that these holding members 154 may be pivoted slightly with respect to the rod 166 and also may be slid along the length of the rod 166 supporting them.

Figures 2, 5, 6, 7:
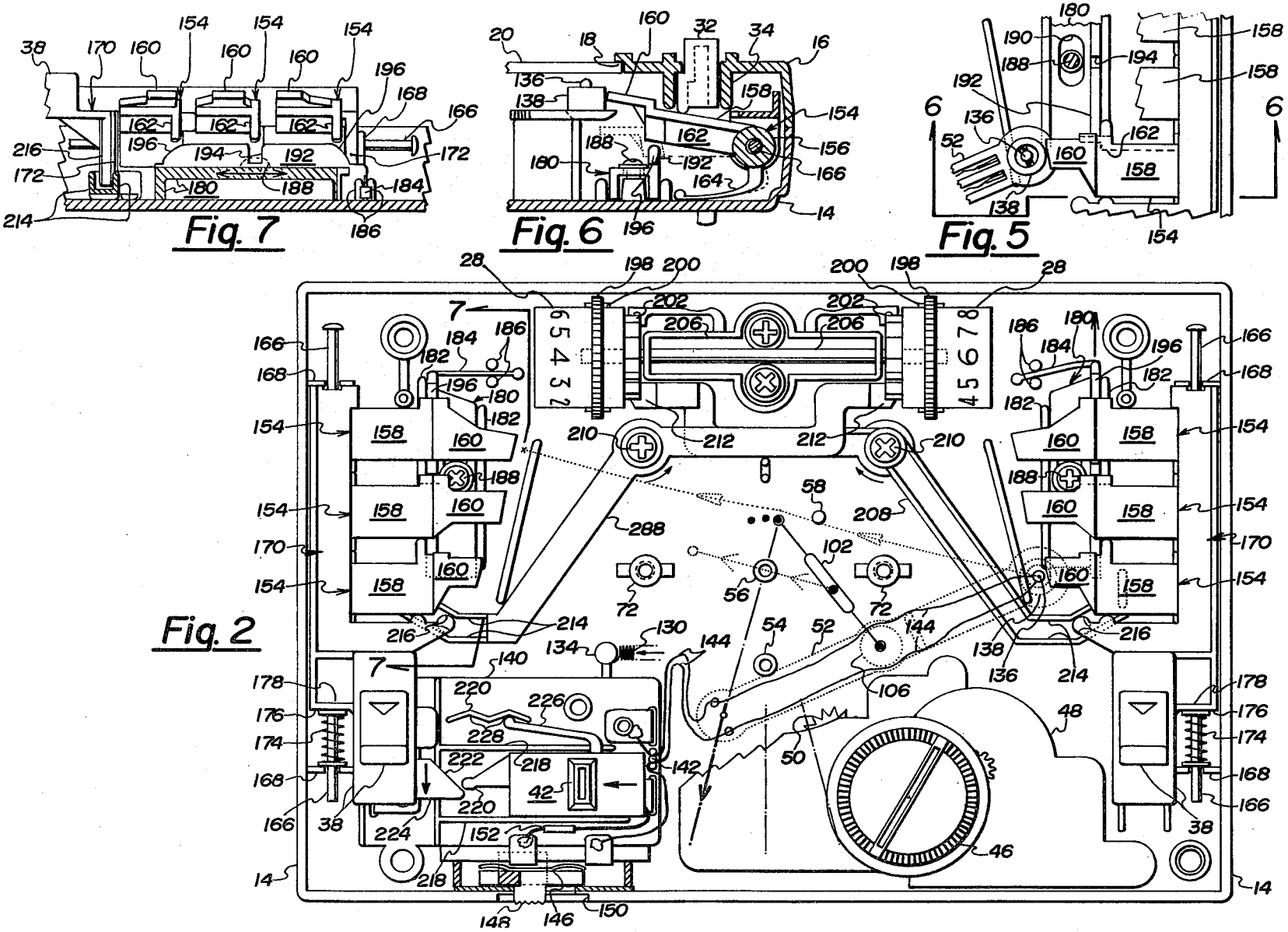
FIG. 2 is a top plan view of the toy game illustrated in the preceding figure with the cover and various operative parts attached to the cover of this toy game removed and with the drive mechanism employed in the toy omitted from the center of the toy in the interest of clarity.
FIG. 5 is a fragmentary view taken in the same direction as FIG. 2 in which parts have been broken away so as to reveal the relationship between certain parts.
FIG. 6 is a partial cross-sectional view taken at line 6—6 of FIG. 5.
FIG. 7 is a partial cross-sectional view taken at line 7—7 of FIG. 2.
Figure 3:
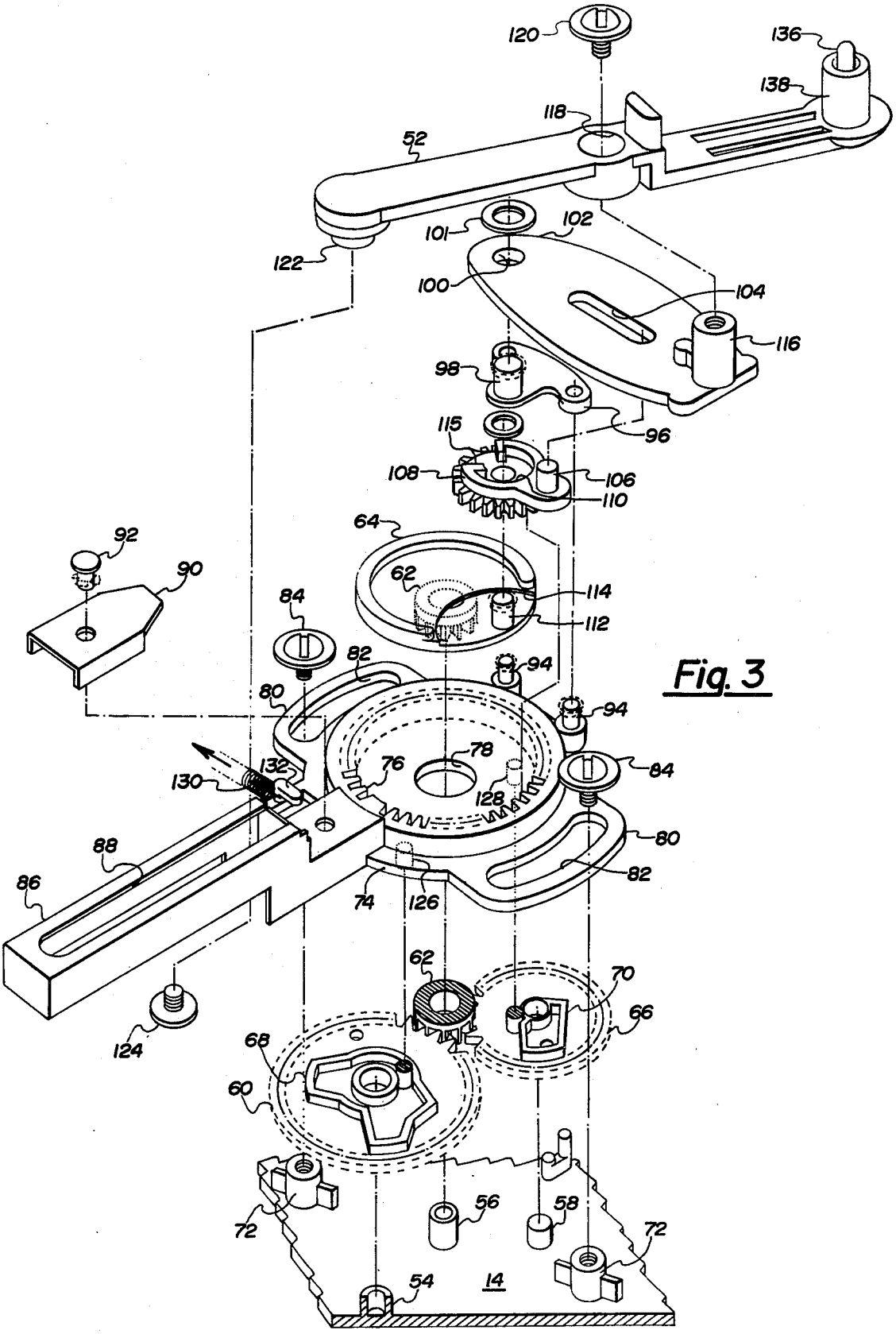
FIG. 3 is an exploded perspective view showing those parts of the drive mechanism which have been omitted from FIG. 2 and showing various dotted lines indicating the interconnections between the various parts illustrated.

Normally the holding members 154 on either rod 166 are biased toward a normal position as indicated in FIG. 2 of the drawing through the use of biasing springs 174 located between retaining flanges 176 secured to the rod 166 and other legs 178 on the retainer frame 170. With this structure either release member 38 may be actuated so as to move all of the associated holding members 154 as a unit from such a normal position. Upon any such actuated release member 38 being no longer engaged, the moved members 154 will be automatically returned to their normal or initial position.

The significance of the holding members 154 is best explained by indicating that the holding ends 160 of these members 154 in such a normal position are located so that any of these ends 160 will slide along and resiliently engage the flat end 138 of the member 52 when the member 52 is moved back and forth relative to the opening 18 in the manner described in the preceding and into contact with an end 160. The mechanical parameters of the various parts described in the preceding are controlled in the toy 10 so that such frictional engagement will place a sufficient "drag" on the entire drive system (not separately numbered) indicated in the preceding to stop or brake the spring motor 48.

The user of the toy 10 will realize when the member 52 is held or "locked up" in this manner because the light source 136 will no longer move. When this occurs the operation of the toy 10 is in effect halted in much the manner in which a game such as tennis, Ping Pong or the like is interrupted when the player of such a game fails to hit back or return the ball in such a game to another player. In a conventional game such as tennis and Ping Pong such an interruption is followed by the ball in such a game being served by a player to the other player.

In the toy 10 this action is achieved by the movement of the release lever 38 so as to slide the retainer frame 170 along a rod 166. This will move all of the adjacent holding members 154 "associated" with such frame 170 to a sufficient extent so as to physically release the end 138 of the member 52. The release action achieved involves a holding end 160 sliding away from the end 138. As this occurs the member 52 will no longer be held by friction and the spring motor 48 will operate so as to move various parts in the manner previously indicated.

Normally such movement would result in the end 138 promptly being engaged by another holding member 154 as it is moved. This is prevented in the toy 10 by a user of the toy pressing down a button 32 toward which the light source 136 is moved. As this occurs the button 32 pressed down will engage the plate 158 of the holding member 154 associated with the actuated button 32 so as to move the end 160 attached to such plate 158 to a position such that the end 160 will not contact the end 138. When this occurs the member 152 can continue its travel as pre-programmed through the drive means (not separately numbered) indicated in the preceding discussion.

This actuation of an appropriate button 32 so as to enable the movement of the member 52 to continue corresponds to the action of a player in an adult game utilizing a racket or similar device so as to return a ball or similar structure to another player. Two players can play a game using the toy 10 without interruption as long as each continues to actuate appropriate buttons 32.

In order to prevent a user of the toy 10 from simultaneously actuating all of the buttons 32 adjacent to one of the ends 22 so as to prevent an interruption corresponding to a ball not being "returned" in a conventional game the toy 10 utilizes an anti-actuation or lockout slide 180 as is best seen in FIG. 7 of the drawings. This slide 180 rests on the base 14 between walls 182 on this base and includes an integral spring 184 extending from it between pins 186 on the base 14. The slide 180 is slidably held along this base 14 through the use of a headed retainer screw 188 loosely fitting within an elongated slot 190 in it. The slide 180 includes an upstanding wall 192 having a centrally located notch 194 which is dimensioned so as to accommodate a wall 162 when a holding member 154 immediately above it is pushed downwardly through the use of a button 32 in the manner described.

This wall 192 also includes curved ends 196 which are adapted to be engaged by walls 162 on holding members 154 as such members 154 are actuated so as to cause the slide 180 to move linearly with respect to the base 14. These curved ends 196 and the notch are dimensioned relative to the spacing of the walls 162 on the holding members 154 when these holding members are held in a normal position by the retainer frame 170 so that the wall 192 will fit under the walls 162 of the holding members 154 above the wall 192 in such a manner as to only permit one of the holding members 154 to be pressed downwardly at a time.

Thus, when a slide 180 is in a position as indicated in FIG. 7 only the central most holding member 154 is capable of being pushed downwardly since the notch 194 is immediately beneath the wall 162 on this holding member 154. Downward motion of the other holding members 154 is blocked by the slide 180 when the notch 194 is engaged. When none of the buttons 32 is pushed down and when the notch 194 is under the central most holding member 154 the position of the slide 180 may be shifted by pushing down on the holding member 154 at either side of the central most holding member. This will cause the wall 162 on the actuated holding member 154 to engage a curved end 196 so as to slide the slide 180 to a position blocking the downward movement of the other holding members 154. The spring 184 will always tend to return the slide 180 to a position as shown in FIG. 7.

Since it is considered desirable to incorporate within the toy 10 a scoring means (not separately indicated) indicating each time that the toy is actuated so as to simulate the serving of a ball and/or each time a ball is placed out of play the particular toy 10 utilizes the score wheels 28 previously described. These score wheels 28 are integral with ring gear-like peripheral flanges 198 which extend outwadly from the base 14 through openings 200 so that they may be manually moved to a desired starting position. These score wheels 28 are also integral with conventional ratchet wheels 202. The score wheels 28 are mounted upon a common shaft 204 which is retained by a holder 206 in the base 14.

Elongated actuating levers 208 are mounted by means of pivots 210 on the base 14 in such a position that resilient pawl like ends 212 on them can engage the ratchet wheels 202 to advance the score wheels 28 in a conventional manner upon movement of these levers 208. These levers 208 include upstanding spaced walls 214 which are located so as to receive pins 216 extending downwardly from the retainer frame 170. These pins 216 can slide within the walls 214 in such a manner as to transmit motion so as to rotate the levers 208 each time the release members 38 are pulled downwardly. As a result of this, movement of a release member 38 so as to cause the release of the end 138 from a holding member 154 is coordinated with the advancement of the score wheel 28.

It is considered important that the toy 10 is constructed so as to permit an individual using this toy 10 to in effect play against himself or herself and/or against the toy itself by utilizing only the buttons 32 at the right hand side of this toy 10. This is accomplished through the use of the latch lever 42. This latch lever 42 is positioned between walls 218 on the battery housing 140 so as to be capable of being linearly moved from the position in which it is shown in FIG. 2 to a position toward the left in which a projection 220 on this latch lever 42 hits against a sloping surface 222 on an extension 224 from the release member 38 at the left hand side of the toy 10.

Such movement of the latch lever 42 serves to slide the release member 38 against the biasing force of the associated spring 174 in order to position all of the associated holding members 154 in locations where the pre-programmed movement of the member 52 will not bring the end 138 into a position in which this end 138 can be engaged and held against movement by any of the holding members 154 at the left side of FIG. 2. This will have the effect of disenabling the buttons 32 at the left hand side of the toy 10 so that the light source 138 will always move away from the left hand side of the toy 10 as if it had been engaged by a racket or paddle, or the like. In order to make sure that the latch lever 42 is not inadvertently moved or does not inadvertently move between its two positions as indicated in the preceding, it is preferred to form a small spring arm 226 integrally with this latch lever 42 in such a manner that this spring arm will engage either of two different depressions 228 and a small wall 230 located on the battery housing 140.

I claim:

1. A toy having a housing, said housing including an opening having elongated, opposed ends through which at least a part of the contents of said housing can be viewed, a member located within said housing so as to be capable of being moved back and forth from between different positions along said ends of said opening, drive means for moving said member back and forth between different positions along said ends of said opening, said drive means being operatively connected to said movable member, in which the improvement comprises:

a holding means for engaging and holding said member against movement, said holding means being movably mounted within said housing so as to be capable of being moved between an engaging position in which it is capable of engaging and holding said member as said member is moved and a non-engaging position in which it will not engage and hold said member.

2. A toy as claimed in claim 1 including:

spring means biasing said holding means in said engaging position, said holding means being capable of being manually manipulated from said engaging position to said non-engaging position.

3. A toy as claimed in claim 1 wherein:

there are a plurality of said holding means positioned adjacent to one another along the length of one of said ends and each of said holding means is capable of being manually manipulated from said engaging position to said non-engaging position.

4. A toy as claimed in claim 3 including:

release means for moving all of said holding means as a unit from a first location in which said holding means are individually capable of being moved between said engaging and said non-engaging positions to a non-engaging location in which none of said housing means is operative to hold said member against movement.

5. A toy as claimed in claim 4 including:

other spring means biasing said release means in said first location.

6. A toy as claimed in claim 5 including: two other spring means, each of said other spring means biasing one of said release means in said first location.

7. A toy as claimed in claim 6 including:

latch means for holding one of said release means in said second location.

8. A toy as claimed in claim 7 including:

a translucent screen covering said opening, a light source located on said member, said light source being visible through said screen.

9. A toy as claimed in claim 1 wherein:

there are a plurality of said holding means positioned adjacent to one another along the length of one of said ends and a plurality of said holding means positioned adjacent to one another along the length of the other of said ends, each of said holding means is capable of being manually manipulated from said engaging position to said non-engaging position, and including a plurality of spring means, each of said spring means serving to bias one of said holding means in said engaging position, a first and a second release means, each of said release means being for the purpose of moving all of said holding means adjacent to one of said ends as a unit from a first location in which said holding means are individually capable of being moved between said engaging and said non-engaging positions to a second non-engaging location in which none of said holding means is operative to hold said member against movement, said first release means being located adjacent to one of said ends, said second release means being located adjacent to the other of said ends, each of said release means being capable of being manually manipulated from said first location to said second location.

10. A toy as claimed in claim 9 including:

two separate anti-actuation means for preventing more than one of said holding means from being manipulated from said engaging position to said non-engaging position at one time, one of said anti-actuation means being located so as to be operative with respect to said holding means at one of said ends, the other of said anit-actuation means being located so as to be operative with respect to said holding means at the other of said ends.

11. A toy as claimed in claim 1 wherein:

said member comprises an elongated arm, said drive means includes a support plate, a reciprocating means for moving said support plate in an irregular, oscillating manner, a crank means pivotally mounted on said support plate, oscillating means for oscillating said crank means relative to said support means and motor means for concurrently operating said reciprocating and said oscillating means, said reciprocating means being operatively connected to said support plate, said oscillating means being operatively connected to said crank means, said motor means being operatively connected to both said reciprocating and said oscillating means, said crank means being pivotally connected to said member and including cooperating sliding connection means located on said arm of said support plate for pivotally and slidingly connecting said arm to said support plate remote from the connection of said crank means and said arm.

12. A toy as claimed in claim 11 wherein:

said reciprocating means including cam means for imparting irregular movement to said support plate.

13. A toy as claimed in claim 12 wherein:

said cam means comprises two separate cams operatively connected to said motor means so as to be moved thereby and two separate cam followers mounted on said support plate, one of said followers engaging one of said cams and the other of said followers engaging the other of said cams.

14. A toy as claimed in claim 1 wherein:

there are a plurality of said holding means positioned adjacent to one another along the length of one of said ends and a plurality of said holding means positioned adjacent to one another along the length of the other of said ends, each of said holding means is capable of being manually manipulated from said engaging position to said non-engaging position, and including a plurality of spring means, each of said spring means serving to bias one of said holding means in said engaging position.

a first and a second release means, each of said release means being for the purpose of moving all of said holding means adjacent to one of said ends as a unit from a first location in which said holding means are individually capable of being moved between said engaging and said non-engaging positions to a second non-engaging location in which none of said holding means is operative to hold said member against movement, said first release means being located adjacent to one of said ends, said second release means being located adjacent to the other of said ends, each of said release means being capable of being manually manipulated from said first location to said second location, two other spring means, each of said other spring means biasing one of said release means in said first location, latch means for holding one of said release means in said second location, a translucent screen covering said opening, a first source located on said member, said light source being visible through said screen, two separate anti-actuation means for preventing more than one of said holding means from being manipulated from said engaging position to said non-engaging position at one time, one of said anti-actuation means being located so as to be operative with respect to said holding means at one of said ends, the other of said anti-actuation means being located so as to be operative with respect to said holding means at the other said ends, and wherein said member comprises an elongated arm, said drive means includes a support plate, a reciprocating means for moving said support plate in an irregular, oscillating manner, a crank means pivotally mounted on said support plate, oscillating means for oscillating said crank means relative to said support means and motor means for concurrently operating said reciprocating and said oscillating means, said reciprocating means being operatively connected to said support plate, said ocillating means being operatively connected to said crank means, said motor means being operatively connected to both said reciprocating and said oscillating means, said crank means being pivotally connected to said member and including cooperating sliding connection means located on said arm said support plate for pivotally and slidingly connecting said arm to said support plate remote from the connection of said crank means and said arm.

15. A toy as claimed in claim 14 wherein:

said reciprocating means includes cam means for imparting irregular movement to said support plate, said cam means comprises two separate cams operatively connected to said motor means so as to be moved thereby and two separate cam followers mounted on said support plate, one of said followers engaging one of said cams and the other of said followers engaging the other of said cams.

16. A toy having a housing, said housing including an opening through which a part of the content of said housing can be viewed, a member located within said housing so as to be capable of moving back and forth between different positions along said ends of said opening, drive means for moving said member back and forth between different positions along said ends of said openings, said drive means being operatively connected to said movable member in which the improvement comprises:

said member comprising an elongated arm, said drive means including a support plate, a reciprocating means for moving said support plate in an irregular, oscillating manner, a crank means pivotally mounted on said support plate, oscillating means for oscillating said crank means relative to said support means and motor means for concurrently operating said reciprocating and said oscillating means, said reciprocating means being operatively connected to said support plate, said oscillating means being operatively connected to said crank means, said motor means being operatively connected to both said reciprocating and said oscillating means, said crank means being pivotally connected to said member and including cooperating sliding connection means located on said arm of said support plate for pivotally and slidingly connecting said arm to said support plate remote from the connection of said crank means and said arm.

17. A toy as claimed in claim 16 wherein:

said recipocating means includes cam means for imparting irregular movement to said support plate.

18. A toy as claimed in claim 17 wherein:

said cam means comprises two separate cams operatively connected to said motor means so as to be moved thereby and two separate cam followers mounted on said support plate, one of said followers engaging one of said cams and the other of said followers engaging the other of said cams.

* * * * *

UNITED STATES PATENT AND TRADEMARK OFFICE

CERTIFICATE OF CORRECTION

PATENT NO. : 4,147,350

DATED : APRIL 3, 1979

INVENTOR(S) : HIKOO USAMI

It is certified that error appears in the above-identified patent and that said Letters Patent are hereby corrected as shown below:

Column 9, line 4, "outwadly" should read --outwardly--.

Column 10 (Claim 4), line 28, "said housing means" should read --said holding means--.

Column 11 (Claim 12), line 37, "including" should read --includes--.

Column 12 (Claim 14), line 13, "a first source" should read --a light source--.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*